US006447326B1

(12) United States Patent
Teach et al.

(10) Patent No.: US 6,447,326 B1
(45) Date of Patent: Sep. 10, 2002

(54) PATCH CORD CONNECTOR

(75) Inventors: William O. Teach, Frankfort; Russell A. Vanderhoof, Minooka, both of IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/635,814

(22) Filed: Aug. 9, 2000

(51) Int. Cl.[7] ..... H01R 13/58
(52) U.S. Cl. ..... 439/460; 439/76.1
(58) Field of Search ..... 439/460, 404, 439/417, 696, 692, 687, 465, 941, 76.1, 344

(56) References Cited

U.S. PATENT DOCUMENTS

| | | | | |
|---|---|---|---|---|
| 3,798,587 A | | 3/1974 | Ellis, Jr. et al. | |
| 3,923,362 A | | 12/1975 | Dunne et al. | |
| 4,295,703 A | | 10/1981 | Osborne | |
| 4,412,715 A | | 11/1983 | Bogese, II | 439/425 |
| 4,878,848 A | | 11/1989 | Inglsbe | |
| 5,001,602 A | | 3/1991 | Suffi et al. | |
| 5,177,782 A | | 1/1993 | Henderson et al. | 374/412 |
| 5,320,548 A | | 6/1994 | Schadhauser | |
| 5,326,286 A | | 7/1994 | Bixler et al. | |
| 5,417,581 A | | 5/1995 | Dechelette et al. | |
| 5,538,438 A | * | 7/1996 | Orlando | 439/344 |
| 5,628,647 A | | 5/1997 | Rohrbaugh et al. | |
| 5,782,652 A | | 7/1998 | Feher et al. | |
| 5,876,221 A | | 3/1999 | Sasaki | |
| 5,905,637 A | | 5/1999 | Su | 361/752 |
| 5,924,896 A | * | 7/1999 | Arnett et al. | 439/676 |
| 5,967,801 A | * | 10/1999 | Martin et al. | 439/76.1 |
| 6,089,923 A | * | 7/2000 | Phommachanh | 439/676 |
| 6,157,542 A | * | 12/2000 | Wu | 361/752 |

FOREIGN PATENT DOCUMENTS

| | | |
|---|---|---|
| WO | WO96/13878 | 5/1996 |

* cited by examiner

*Primary Examiner*—P. Austin Bradley
*Assistant Examiner*—Ross Gushi
(74) *Attorney, Agent, or Firm*—Robert A. McCann; Jay A. Saltzman; Christopher S. Clancy

(57) ABSTRACT

A patch cord connector for electrically and mechanically connecting a plurality of wires from a cable into a patch panel. The connector includes a housing having a cable entry aperture, a load bar retainable in the housing for arraying termination points of the plurality of wires into a predetermined configuration, and a printed circuit board having a first set of terminals for engaging the arrayed termination points of the plurality of wires and a second set of terminals for engaging the patch panel. The first and second sets of terminals are electrically connected by the printed circuit board. The housing includes a retention mechanism for retaining the cable and providing strain relief relative to the cable entry aperture and/or includes complementary support structure between the housing and the terminal to provide strain relief to the printed circuit board.

6 Claims, 5 Drawing Sheets

PATCH CORD CONNECTOR

BACKGROUND OF THE INVENTION

Patch cord connectors may be used to connect patch panels or other organizational devices in a particular network to specific inputs, outputs, or other such electrical apparatus. A particular example of application would be to use a patch cord having an appropriate connector at each end thereof to connect a pair of patch panels disposed on one or more cable management racks, as part of a sophisticated computer network for a business.

Existing connectors for such cables are prone to failure when they are being engaged or removed from particular applications due to stresses and strains that are applied to the connector in these processes. Network maintenance often requires rearrangement of particular electrical connections, and, as such, often requires multiple connector removals and engagements to obtain a newly desired network configuration. Those making the changes do not always grip the connectors properly for removal or application, either due to lack of time, lack of access, or for some other reason. Sometimes the network operators or maintenance persons will pull on a cable to disengage a connector from a patch panel for example. Sometimes such persons might remove or apply the connector from a direction not substantially perpendicular to the patch panel or other attached device. In any of the above cases, patch cord connectors are often subjected to stresses and strains that can have undesirable affects on the integrity and functionality of the electrical connections and electrical apparatus therein.

Pulling on a cord, rather than on the associated connector body, for example, can cause the wires housed within the cord or cable to detach from electrical components, such as a printed circuit board, in the connector body. Connector application or removal that is not substantially perpendicular to the device may result in stresses and strains being applied directly or indirectly to components internal to the connector body, such as the printed circuit board. Such stresses and strains may cause such internal components to fail. Thus, there is a need for a patch cord-type connector having resistance to failure despite frequent stresses and strains being placed on the connector body as the connector is applied or removed under real-world conditions.

SUMMARY OF THE INVENTION

To address the above-described need, a novel strain-relief patch cord connector is described below. One embodiment of the invention is a patch cord connector for electrically and mechanically connecting a plurality of wires from a cable into a patch panel. The connector includes a connector housing having a cable entry aperture for the cable, a load bar retainable in the housing, the load bar for arraying termination points of the plurality of wires into a predetermined configuration, and a printed circuit board retainable in the housing, the printed circuit board having a first set of terminals for engaging the arrayed termination points of the plurality of wires and a second set of terminals for engaging the patch panel. The first and second sets of terminals are electrically connected by the printed circuit board. The housing includes a retention mechanism for retaining the cable and providing strain relief relative to the cable entry aperture.

Another embodiment of the invention is a patch cord connector for electrically and mechanically connecting a plurality of wires from a cable into a patch panel. The connector includes a connector housing having a cable entry aperture for the cable, a load bar retainable in the housing for arraying termination points of the plurality of wires to a predetermined configuration, and a printed circuit board retainable in the housing. The printed circuit board has a first set of terminals for engaging the arrayed termination points of the plurality of wires and a second set of terminals for engaging the patch panel. The first and second sets of terminals are electrically connected by the printed circuit board. The second set of terminals is engageable with the housing for providing strain relief to the printed circuit board.

Yet another embodiment of the invention is a terminal for a patch cord connector, the terminal for electrically and mechanically connecting with a printed circuit board at one end thereof and a patch panel at a second end thereof. The terminal includes an elongated conductive portion, a first contact portion for insertion into and electrical communication with the printed circuit board, an alignment post for insertion into the printed circuit board to prevent rotation of the terminal with respect thereto, and a second contact portion for insertion into an electrical communication with the patch panel. The elongated conductive portion includes a transverse notch therein disposed between the first and second contact portions. The notch accommodates complimentary structure from the connector housing to support the terminal within the housing.

DESCRIPTION OF THE PREFERRED EMBODIMENTS

Applicants claim, under 35 U.S.C. §119(e), the benefit of priority of the filing date of Aug. 10, 1999, of U.S. Provisional Patent Application Serial No. 60/148,039, filed on the aforementioned date, the entire contents of which are incorporated herein by reference.

The present invention relates to an electrical connector, and more particularly to an improved, inexpensive, 110-style patch cord connector with improved crosstalk performance, improved cable strain relief, and improved printed circuit board strain relief.

Figure 1:
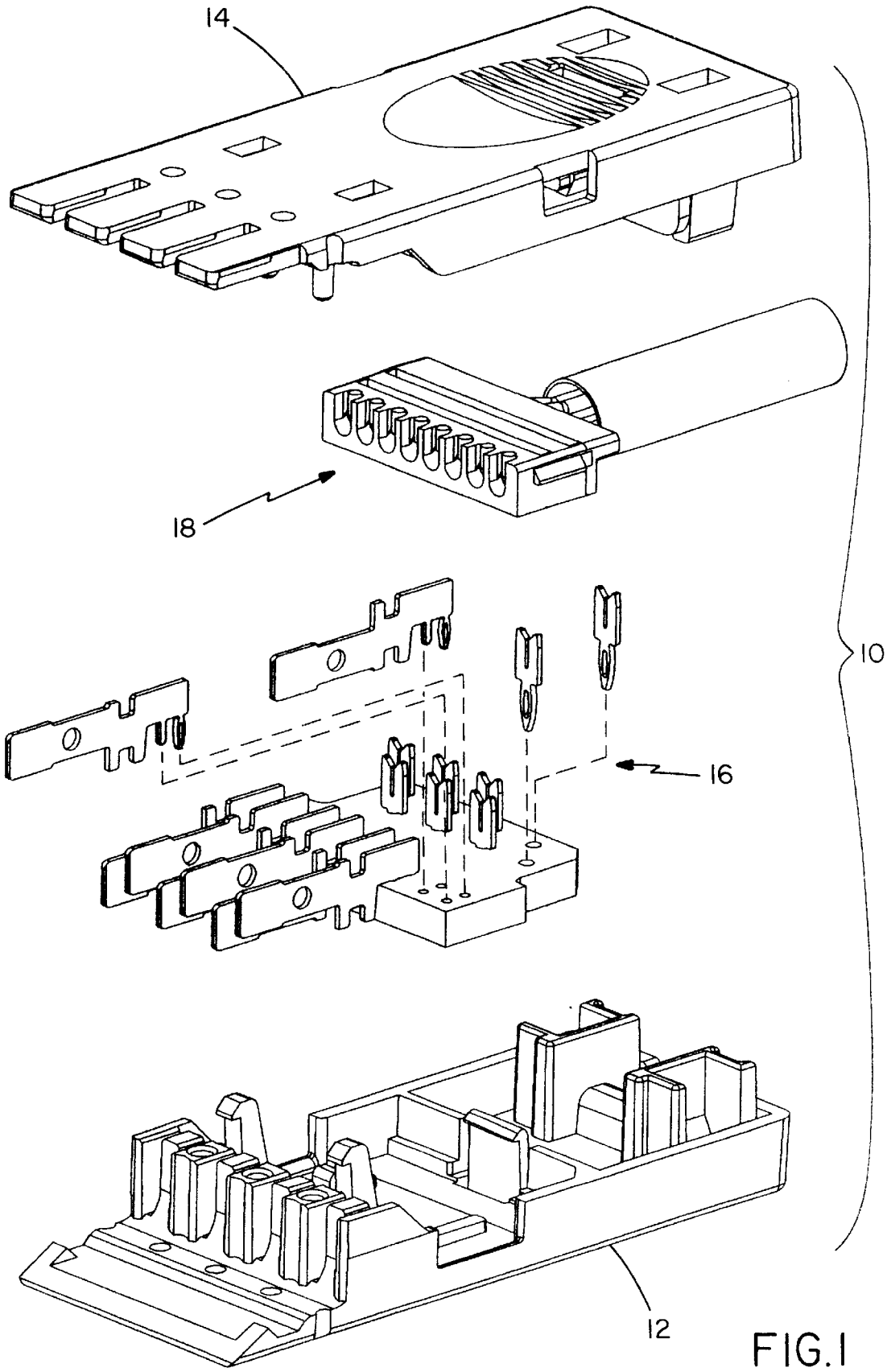
FIG. 1 is an exploded perspective view of a connector in accordance with an embodiment of the invention.

FIG. 1 shows an exploded view of an embodiment of the inventive patch cord connector. In particular, the connector 10 includes a housing having a base 12 and a cap 14 for mutually interengaging and protectably retaining interior components of the connector. The interior components include a printed circuit board/terminal assembly 16 and a load bar assembly 18, both sandwiched between the cap and base.

Figure 2:
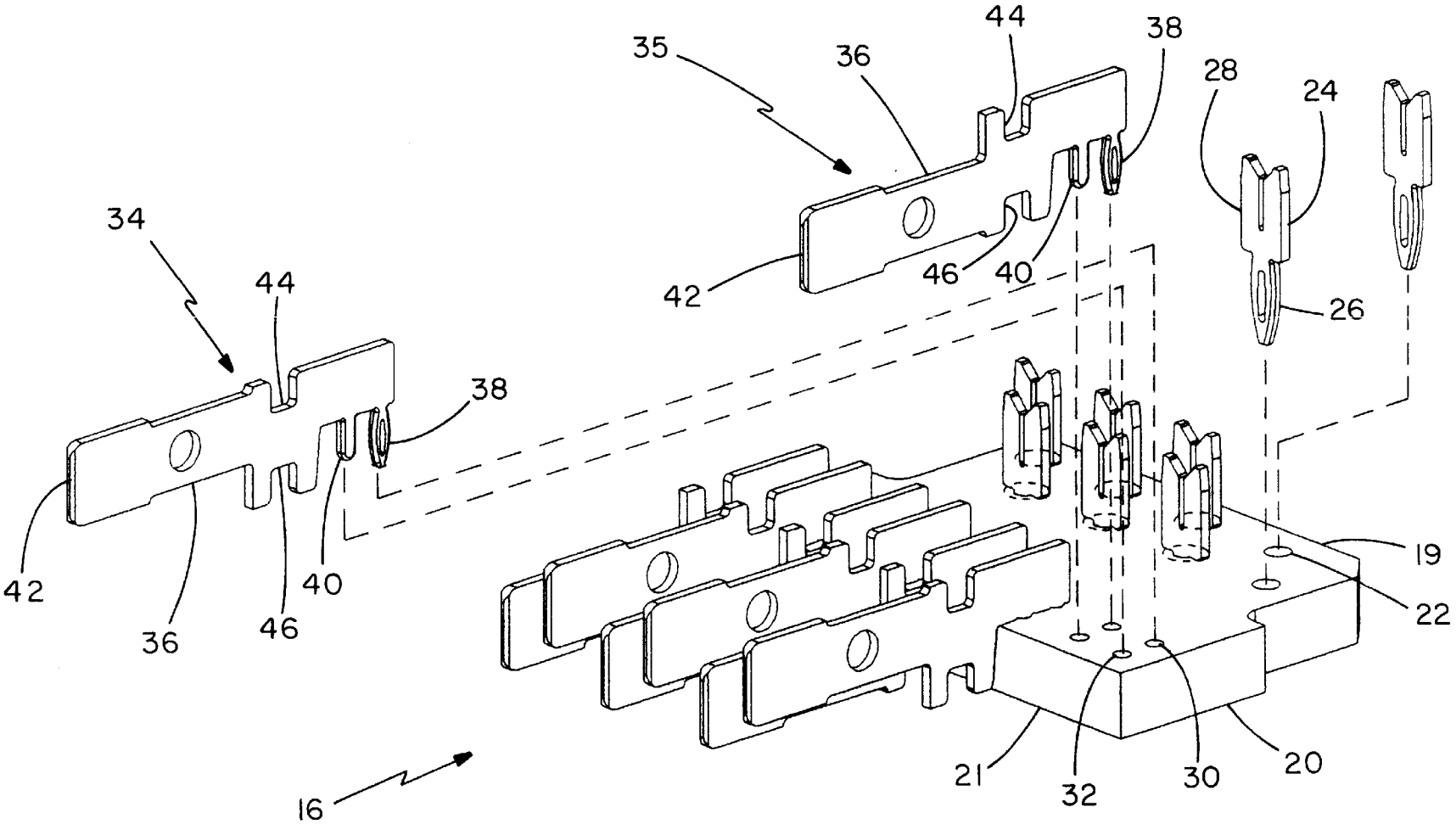
FIG. 2 is a partially exploded perspective view of a contact/printed circuit board arrangement in accordance with an embodiment of the invention.

FIG. 2 shows an electrically communicative printed circuit board/terminal assembly 16 in accordance with an embodiment of the invention. The assembly includes a printed circuit board (PCB) 20, four staggered pairs of insulation displacement contacts (IDC's) 24, and four staggered pairs of plug interface contacts (PIC's) 34 and 35. The PCB is manufactured and formed in a known manner in which conductive traces are placed on a bottom side in a desired configuration to reduce instability and to enhance connector performance. The IDC's are aligned in a staggered configuration along at least two parallel rows at the proximal end 19 of the PCB 20. The IDC's are of conventional form and are pressed into and secured within an IDC aperture 22 of the PCB 20 with a compliant pin 26 design while the IDC legs 28 extend upwardly from the compliant pin 26.

In correspondence to the staggered configuration of the IDC's are two sets of novel PIC's, one having a high contact configuration 34, and the other having a low contact configuration 35. These high and low PIC's have elongated bodies 36 and are sequentially alternated along a distal edge 21 of the PCB 20 opposite that of the IDC's 24. Such configuration enables superior connector performance in high speed data transmission environments. All the PIC's are secured to the PCB with a compliant pin 38 design and an additional alignment post 40 disposed adjacent the compliant pin to prevent the contacts 34 and 35 from rotating after being pressed into the PCB. Thus, both the PIC's and IDC's are inserted into the PCB from the same direction and are both primarily secured therein with a compliant pin design. Preferably, the compliant pin 38 of the PIC is disposed adjacent a proximal end of each PIC with the alignment post 40 disposed further from the proximal end in the direction of the distal end 42. Located adjacent the alignment posts 40 of the PIC's, but further away from the proximal ends and closer to the distal ends are upper load transfer notches 44 and lower load transfer notch 46. After all of the PIC's have been inserted into the PCB, the load transfer notches are aligned such that they form troughs on the upper and lower surfaces which may interface with other elements of the patch cord connector to transfer load forces and to prevent terminal movement. While the figures specifically depict an assembly having four pairs of staggered IDC's and PIC's, the invention is not limited to this particular configuration.

Figure 3:
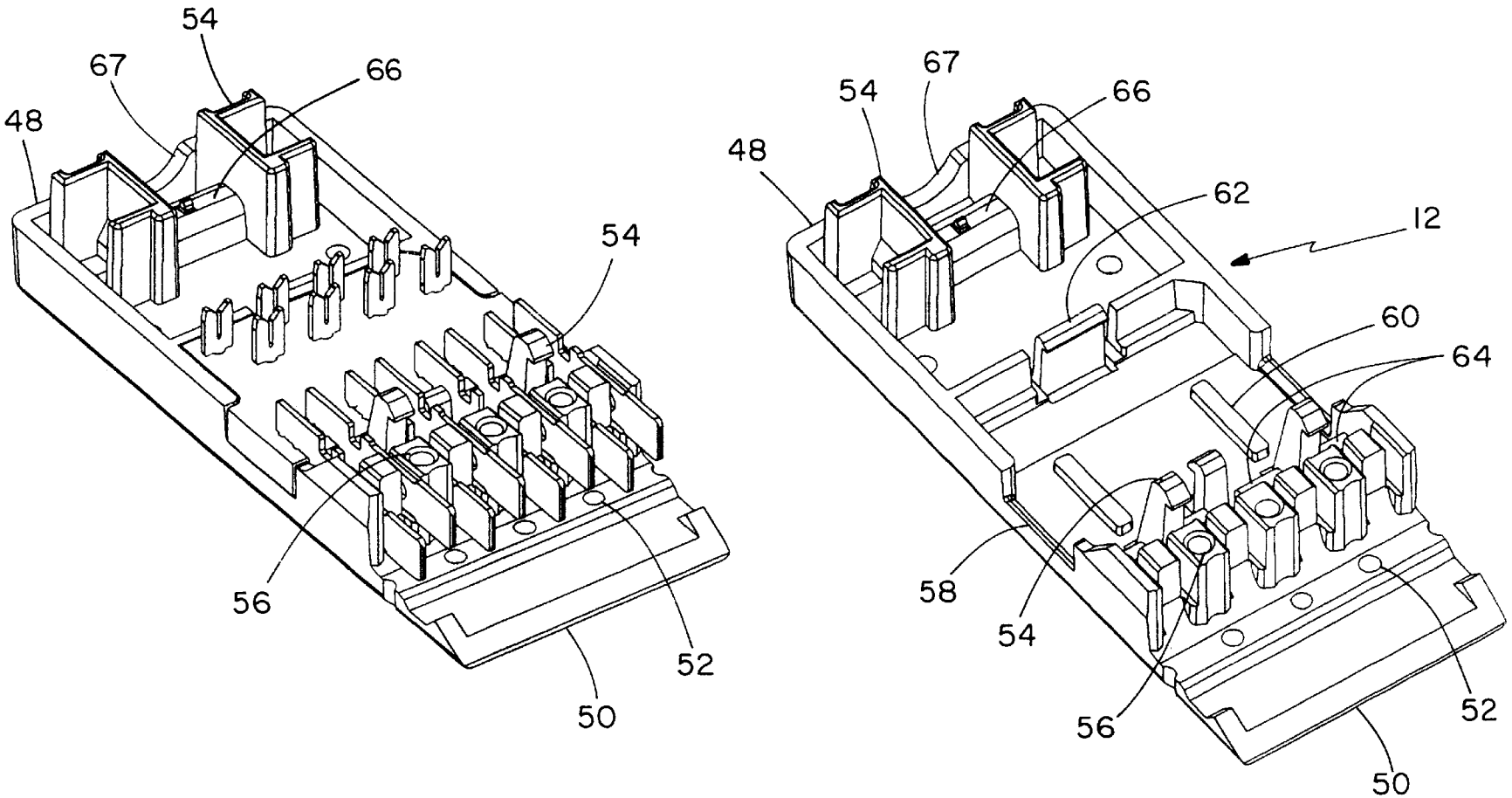
FIG. 3 is a pair of perspective views of a base portion of the connector in accordance with an embodiment of the invention wherein one of the views shows the contact/printed circuit board assembly of FIG. 2 appropriately engaged with base portion.

FIG. 3 shows an isolated connector base 12 as well as the connector base with the PCB/terminal assembly 16 fitted therein. The base holds the PCB/terminal assembly prior to termination and provides features for mating with a connector block/patch cord. After the PCB/terminal assembly has been assembled, it may be secured in the medial portion of the base and secured thereto by a pair of alignment and retention latches 54, alignment notches 58, support ribs 60, and PCB assembly latch 62. One of the latches 54 is disposed adjacent the IDC's and the other is disposed adjacent the PIC's. Alignment block apertures 56 are disposed to receive mating structure from the cap 14. A load transfer rib 64 engages the trough formed by the lower notches 46 of the PIC's. A strain relief hump 66 is provided to compress the cable upon assembly. This prevents removal of the cable from the patch cord connector 10 and prevents the potential tear-away failure of the cable and wire conductors which may result thereby. While the strain relief hump 66 is disposed at the proximal end 48 of the base 12, the connector block mating features are disposed at a distal end 50 thereof. These mating block features enable the patch cord to securely interface with a connector block using features similar to the 110-style system. Namely, the patch cord connector base 12 uses apertures 52 which accept spherical projections from the connector block and have latches which secure the patch cord connector thereto.

Figure 4:
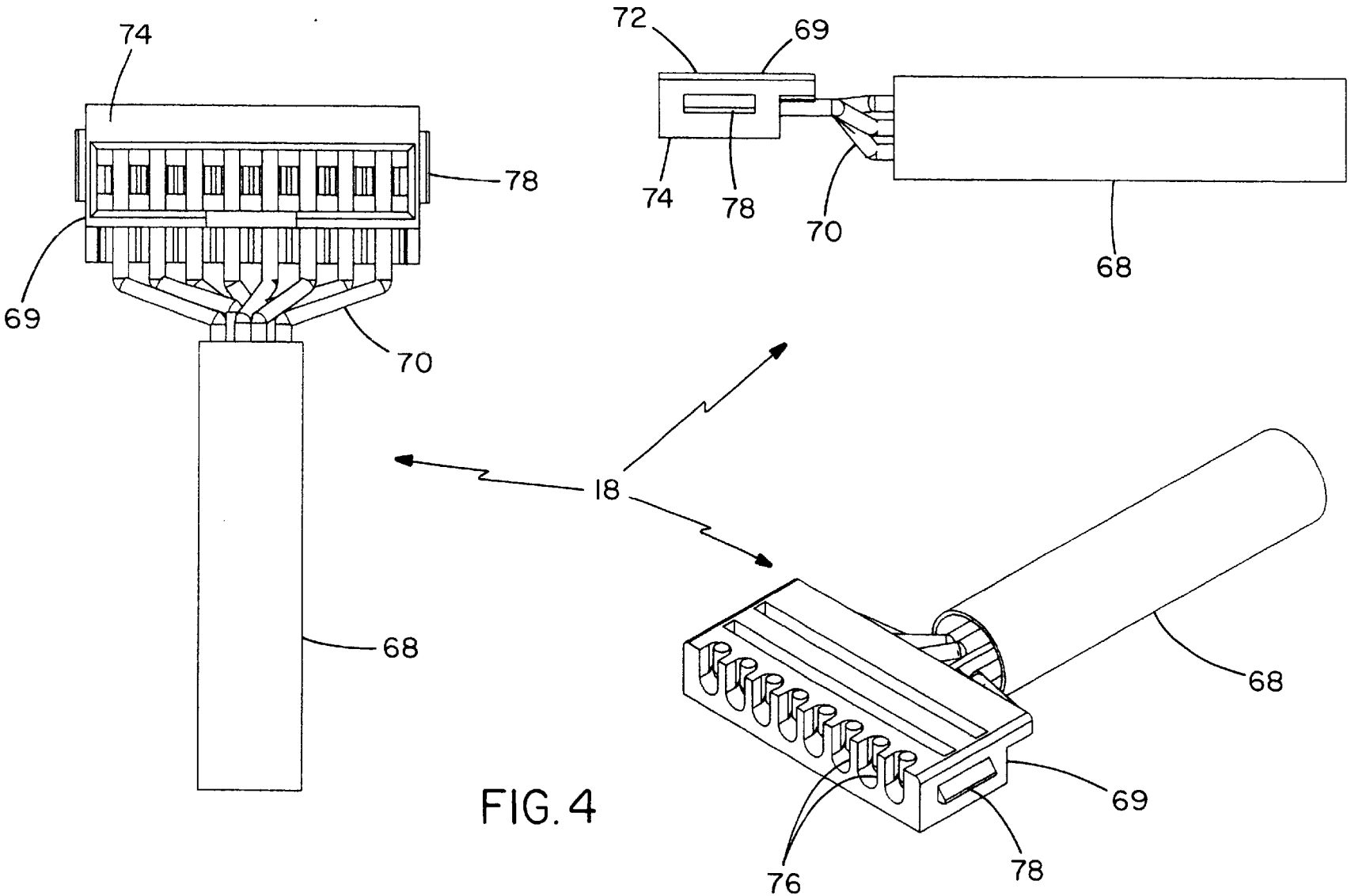
FIG. 4 shows top, side elevational, and perspective views of a load bar in accordance with an embodiment of the invention.

FIG. 4 shows a load bar assembly 18 for organizing and positioning the individual conductors. The wire twists 70 from the cable 68 may be pulled close to the point of IDC termination in order to substantially reduce crosstalk and improve connector performance. In particular, each wire is inserted into appropriate wire holes according to color identification 74 located on the bottom face of the load bar 69. Once the wires 70 are inserted, their twists can be pulled close to the point of IDC termination, an important feature for category 6 performance. Once organized, the wires can then be bent downward, opposite the color identification, thereby securing the twist position. Trimming is performed on a trimming surface 72 of the load bar 69, and the cut wires point toward the top surface of the cap, away from the PCB. The load bar 69 includes dielectric wire separation ribs 76 between each wire to eliminate the possibility of short circuits caused by the inadvertent touching of exposed wires. After organizing and trimming the wires, the load bar is positioned prior to termination. By matching up the color identifications on the load bar and the cap, positioning is completed by pressing the pieces together. Alignment latches 78 facilitate insertion of the load bar assembly 18 into the cap 14.

Figure 5:
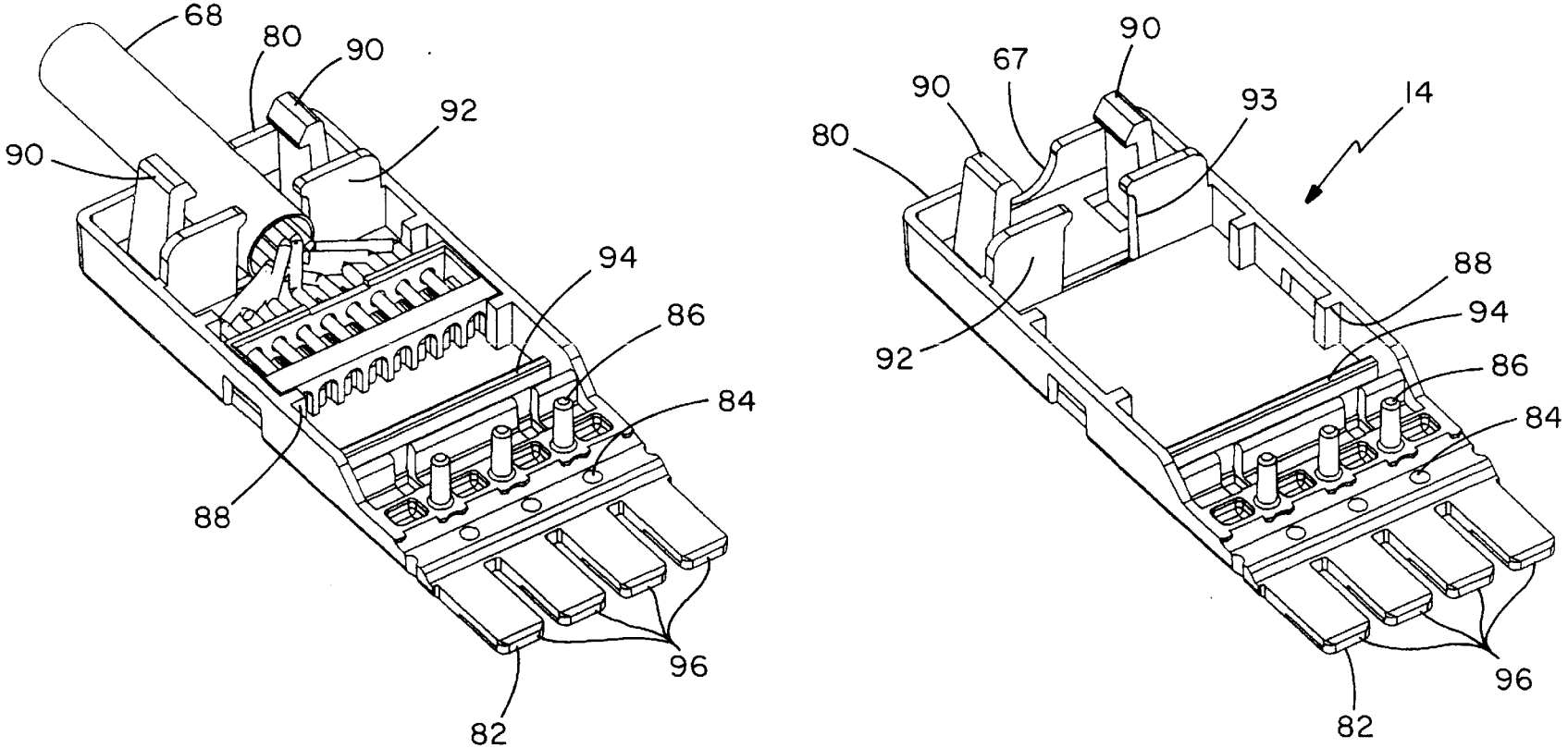
FIG. 5 shows a pair of perspective views of a cap portion of a connector in accordance with an embodiment of the invention wherein one of the perspective views shows the load bar of FIG. 4 appropriately engaged therewith.

FIG. 5 shows the preferably integrally molded connector cap 14 for providing cable retention, facilitating termination, polarizing the connector block mating, and, in conjunction with the connector base 12, securing all the components of the connector 10 together. FIG. 5 shows the cap 14 in isolation, as well as with the load bar assembly 18 of FIG. 4 pressed and snap-fitted into the cap. The cable 68, which encloses multiple wire conductors 70, is secured into a slot or aperture 93 formed in a cable retention wall 92 near the proximal end 80 of the cap. Disposed between the cable retention wall and the proximal end of the cap are a plurality of alignment latches 90 which interface with corresponding latch structure 54 on the base 12 to integrally secure the patch cord connector housing. Disposed adjacent the distal end 82 of the cap are a plurality of alignment posts or bosses 86 which interface with alignment block apertures 56 disposed on the base 12 to ensure proper orientation and alignment. Alignment ribs 88 also ensure proper positioning of the load bar assembly 18 in the cap 14. The distal end of the cap also includes polarizing features 96 for connector block mating, and the connector blocks mate with patch cords using features that are similar to the 110-system. In particular, the patch cord connector cap has apertures 84 which accept spherical projections on the connector block. The cable retention wall 92 is located directly behind the load bar 69 and incorporates a pinch point or interference fit at the slot or aperture 93 that prevents the cable or cable jacket from falling out of position prior to termination. Importantly, load transfer rib 94 transfers strain from the interior components to the housing, thereby reducing failure situations under loaded conditions.

Returning to FIG. 1 and its exploded view of the patch cord connector, the relative position and orientation of the various components of the patch cord connector 10 can be seen. The cap 14 and base 12 form an exterior housing for the PCB/terminal assembly 16 and load bar assembly 18, and the housing includes a cable entry 67 for permitting the cable 68 to pass into the housing. In particular, once the IDC's and PIC's are secured to the PCB by use of the compliant pins thereon, the PCB/terminal assembly 16 may be snap-locked into the base 12. Upon completing this action, the lower load transfer notches 46 receive a load rib 64, which is an integrally formed part of the base 12 in the trough which they have formed. This important feature of the present invention enables the base and cap, when assembled into a housing, to bear the insertion and retraction forces exerted upon the PlC's when inserted and removed from the connector block. After the load bar assembly 18 has been snapped into the cap 14, final assembly may be initiated. The alignment latches 90 and alignment posts 86 of the cap are positioned over the respective and corresponding elements on the base 12 and are then snap-locked together. Upon doing so, the cap load transfer rib 64, which is integrally formed with the cap 14, engages the upper load bearing notches 44 on the plurality of PIC's and becomes disposed in the troughs which they have formed.

The base and cap load ribs are preferably sized to be accepted in the load transfer notches or trough formed by the plurality thereof in a slight interference manner. As a result, one can see that the compliant pin 38 and alignment post 40 disposed at the proximal end of the PIC's are protected from bearing the loads of insertion and removal. The load rib/trough combination transfers the load to the base/cap housing assembly such that the body of the patch cord connector bears all of the insertion and removal loads. As a consequence, durability and reliability of the connector are substantially increased.

While a particular embodiment of the present invention has been shown and described, it will be obvious to those skilled in the art that changes and modifications may be made without departing from the invention and its broader aspects. The matter set forth in the foregoing description and accompanying drawings is offered by way of illustration only and not as a limitation. The invention is described in the following claims.

What is claimed is:

1. A patch cord connector for electrically and mechanically connecting a plurality of wires from a cable into a patch panel, said connector comprising:

a connector housing having a cable entry aperture for said cable;

a load bar retainable in said housing, said load bar for arraying termination points of said plurality of wires into a predetermined configuration; and a printed circuit board retainable in said housing, said printed circuit board having a first set of terminals for engaging said arrayed termination points of said plurality of wires and a second set of terminals for engaging said patch panel, said first and second sets of terminals being electrically connected by said printed circuit board;

said housing including a retention mechanism for retaining said cable and providing strain relief relative to said cable entry aperture.

2. A patch cord connector in accordance with claim 1 wherein said retention mechanism includes a retention wall having an aperture for pinchingly retaining said cable.

3. A patch cord connector for electrically and mechanically connecting a plurality of wires from a cable into a patch panel, said connector comprising:

a connector housing having a cable entry aperture for said cable;

a load bar retainable in said housing, said load bar for arraying termination points of said plurality of wires into a predetermined configuration; and a printed circuit board retainable in said housing, said printed circuit board having a first set of terminals for engaging said arrayed termination points of said plurality of wires and a second set of terminals for engaging said patch panel, said first and second sets of terminals being electrically connected by said printed circuit board;

said second set of terminals being engageable with said housing for providing strain relief relative to said printed circuit board.

4. A patch cord connector in accordance with claim 3, wherein at least one of said second set of terminals includes a notch for accommodating complementary structure from said connector housing to support said terminal within said housing and provide strain relief relative to said printed circuit board.

5. A patch cord connector in accordance with claim 4, wherein said terminal further includes an elongated conductive portion, a first contact portion for insertion into and electrical communication with said printed circuit board, said first contact portion being disposed proximate said first end of said elongated conductive portion, an alignment post for insertion into said printed circuit board to prevent rotation of said terminal with respect thereto, and a second contact portion for insertion into and electrical communication with said patch panel, said second contact portion being disposed proximate said second end of said elongated conductive portion, said notch being transversely disposed between said first and second contact portions.

6. A patch cord connector in accordance with claim 4, wherein said complimentary structure includes a rib integral with said housing for supporting said terminal by engagement with said notch.

* * * * *